United States Patent [19]

Nitschko et al.

[11] 4,365,822

[45] Dec. 28, 1982

[54] FRONT OR REAR JAW

[75] Inventors: Theodor Nitschko; Franz K. Edinger, both of Vienna, Austria

[73] Assignee: TMC Corporation, Baar, Switzerland

[21] Appl. No.: 186,787

[22] Filed: Sep. 12, 1980

[30] Foreign Application Priority Data

Sep. 19, 1979 [AT] Austria ..... 6135/79

[51] Int. Cl.[3] ..... A63C 9/08

[52] U.S. Cl. ..... 280/625; 280/628

[58] Field of Search ..... 280/626, 628, 629, 630, 280/627, 631, 632, 625

[56] References Cited

U.S. PATENT DOCUMENTS

| | | | |
|---|---|---|---|
| 3,408,087 | 10/1968 | Ramillon | 280/631 |
| 3,638,959 | 2/1972 | Rouge | 280/625 |
| 3,768,822 | 10/1973 | Kanno | 280/626 |
| 3,822,071 | 7/1974 | Mottet | 280/625 |
| 3,950,002 | 4/1976 | Schweizer et al. | 280/625 |
| 4,095,821 | 6/1978 | Salomon | 280/630 |
| 4,298,213 | 11/1981 | Storandt | 280/628 |

FOREIGN PATENT DOCUMENTS

| | | |
|---|---|---|
| 1906364 | 10/1969 | Fed. Rep. of Germany . |
| 1578887 | 7/1970 | Fed. Rep. of Germany . |
| 2812149 | 10/1978 | Fed. Rep. of Germany . |

*Primary Examiner*—Joseph F. Peters, Jr.
*Assistant Examiner*—Michael Mar
*Attorney, Agent, or Firm*—Blanchard, Flynn, Thiel, Boutell & Tanis

[57] ABSTRACT

A front jaw or a rear jaw for use in a ski binding arrangement. The jaw utilizes a support member which has a ski boot sole engaging structure for releasably holding the ski boot onto the ski. The ski boot holding structure facilitates a movement of the ski boot relative to the ski during a release operation in both the horizontal and vertical directions as well as solely in the vertical direction and solely in the horizontal direction. The support member supporting the ski boot holding members is guided for movement in a direction parallel to the longitudinal axis of the ski and is urged into engagement with the ski boot by a spring which is separate from the release spring.

10 Claims, 8 Drawing Figures

FRONT OR REAR JAW

FIELD OF THE INVENTION

The invention relates to a front or rear jaw of a ski binding having a support member supporting at least two pins arranged symmetrically with respect to the longitudinal center plane of the jaw, in the position of use in a plane which extends perpendicularly with respect to the longitudinal direction of the ski, about each of which pins a sole holding member is pivotally supported, which holding members rest each with an arm on the boot sole or on the heel and are supported with their other arm on a part which is movable in longitudinal direction of the ski against the force of a first spring and further having, if desired, a downholding means, which can be swung out in a plane which extends vertically with respect to the upper surface of the ski.

BACKGROUND OF THE INVENTION

In such a conventional ski binding part according to German OS No. 15 78 887, in which, however, no further sole or heel holder is provided, the lever arms engage a socalled stroke reducer. Same is a part onto which acts the spring and which is movable transversely with respect to the active direction of the spring, wherein inclined surfaces of the lever arms slide on inclined surfaces of the stroke reducer. This is not only a very expensive construction, but also a construction which is easily susceptible to breakdown. Furthermore, very high friction forces occur between the moveable stroke reducer, support with respect to the spring and the inclined surfaces of the toggle-lever arms.

In an improved embodiment these disadvantages were avoided by constructing the movable part in the form of a rack as a rotary member with at least one rotating groove and movably supporting same in the longitudinal center plane of the jaw between the pivot axes of the sole holders. One precaution was here also taken, namely, a further sole or heel holder is provided between the two sole or heel holders, which further sole or heel holder is pivotal about an axis which is arranged transversely with respect to the longitudinal center plane of the jaw and parallel with respect to the upper surface of the ski, grips over the sole of the shoe or the heel and also with at least one extension engages the groove which is arranged on the spring-loaded rotary member. All these embodiments are described in Austrian Patent No. 315 041.

One disadvantage of this known construction consists in the further sole or heel holder opening in the same degree as the two sole or heel holders, so that, even if no vertical forces occur, which would cause a release of the further sole or heel holder, same releases the sole or the heel of the ski boot and through this also brings about undesired release operations. It is particularly disadvantageous that the skier, in the case of forces which purely act in the horizontal plane, looses the hold of the ski shoe from above, which causes during downhill skiing an insecurity. Finally, a still further disadvantage of this known solution lies in all release operations being started against the force of one single spring, however, as is known, the release force which acts in the horizontal plane is to be approximately half the size of the force which acts in the vertical plane.

A different front jaw is described in German OS No. 20 44 264, in which, however, only the individual sole holders are provided, which can be released either against the force of one single spring or against the force of each one single spring.

German OS No. 19 06 364 describes a front part of a safety ski binding, in which a one-part sole holder can be swung against the force of a spring both in a horizontal and also in a vertical plane, wherein the swinging in both planes occurs so to speak according to a pregiven control. For this reason, this conventional construction is just as disadvantageous as is the solution according to Austrian Patent No. 315 041 with the further sole or heel holder, wherein an additional disadvantage consists in the single sole holder releasing during the release operation an area of the ski shoe, however, at the same time clamping the other area of the same, which can cause undesired frictions.

A different embodiment according to German OS No. 28 12 149 uses also a one-part sole holder, which can be released against the force of one single spring, wherein for the purpose of control in a vertical plane, additional intermediate pieces are provided, which assure a pivoting of the sole holder about a horizontal axis, as soon as forces acting in this direction occur. Again, the increased number of structural parts is disadvantageous in this known construction, which parts cause additional friction forces inside of the jaw member. The difference between the forces which act in the horizontal and in the vertical plane can thereby only be overcome by suitable translations of said additional structural parts, which circumstance results necessarily in compromising solutions.

The purpose of the invention is to provide design of a front or rear jaw of the abovementioned type so that the listed disadvantages are avoided and this jaw reacts both to a pure horizontal and also a pure vertical release and, in addition, also to a diagonal release having both vertical and horizontal components of movement due to its construction and through compensating the occuring friction forces.

The set purpose is inventively attained by the support member being also guided in longitudinal direction of the ski, and being pressed against the shoe by a further spring. This measure makes it possible for the support member which supports the two sole or heel holders to be moved in direction of the longitudinal axis of the ski at the occurrence of an overload, thus without friction of the ski shoe as easier release of the same can be assured. Also, in the case of a twisting fall which as is known is dangerous, the release of the ski shoe is made substantially easier.

A particularly advantageous embodiment of the invention consists in the down-holding means being able to be swung out against the force of the further spring. In this manner the spring forces and characteristics which are decisive for the horizontal and vertical release can be determined in an optimum manner, whereby the two springs are then together effective for the release operations.

According to the invention, it is further provided, that the first spring, which is effective against a lateral release, as it is known by itself, is constructed as a tension spring, however, the further spring is constructed as a pressure or compression spring, and that the two springs are preferably arranged concentrically to one another, wherein the compression spring envelopes the tension spring. Through this measure a concentric design of the jaw is assured.

A different inventive thought consists in the end of the tension spring, which end faces the support member, being anchored on a slide member which preferably also has an indicator, which slide member in turn can be adjusted together with the support member and relative with respect to the ski-fixed abutment. This measure creates a particularly simple connection for the tension spring on the slide member, which permits a loading of the two extensions of the individual sole or heel holders. Furthermore, an indicator can be provided directly on the slide member, through which the number of the necessary structural parts can be reduced.

In a further development of the thought of the invention, a slide member is provided which slides in the groove of a guide piece, to assure a swinging out of the individual bent levers independently from one another.

A different thought of the invention lies in a jaw, in which the two sole or heel holders are designed as bent or two arm levers, such that the support member is constructed as a frame supporting a guide plate which is movable on the rail of the jaw and on its upwardly projecting region a bearing sleeve, on which is provided by means of a bearing axle a support part for the further sole or heel holder, wherein the latter is held on the support part with an elastic element positioned therebetween. This measure assures, that, during a release operation in the vertical direction, the further sole or heel holder constantly maintains its vertical position, whereby the elastic element is slightly deformed between the support part and the sole down-holding means.

In a still further characteristic of the invention, there are provided two sliding surfaces in the region of the ski-fixed part which extend in a plane which lies substantially vertically with respect to the upper surface of the ski and normally with respect to the longitudinal axis of the ski, on each of which sliding surfaces rests a roller in the downhill skiing position, which rollers are supported on the lateral arms of a support part of the further sole or heel holder, that the two rollers are arranged resting on the sliding surfaces and are arranged slidably movably along the same, and that the two sliding surfaces each have a roll-off edge, which is exceeded by the rollers upon reaching a predetermined overload, whereby the further spring (compression spring) is at least at times relieved and the further sole or heel holder is released.

Through the listed inventively important measures, it is achieved in the end effect that with a simultaneous movement upwardly and toward the fixed part, the friction is compensated for and practically a constant release force is achieved, whereby the tension spring relaxes, however, the compression spring is loaded.

BRIEF DESCRIPTION OF THE DRAWINGS

Further details, advantages and characteristics of the invention will be discussed in greater detail hereinbelow with reference to the drawings, in which.

DETAILED DESCRIPTION OF THE DRAWINGS

Figure 1:
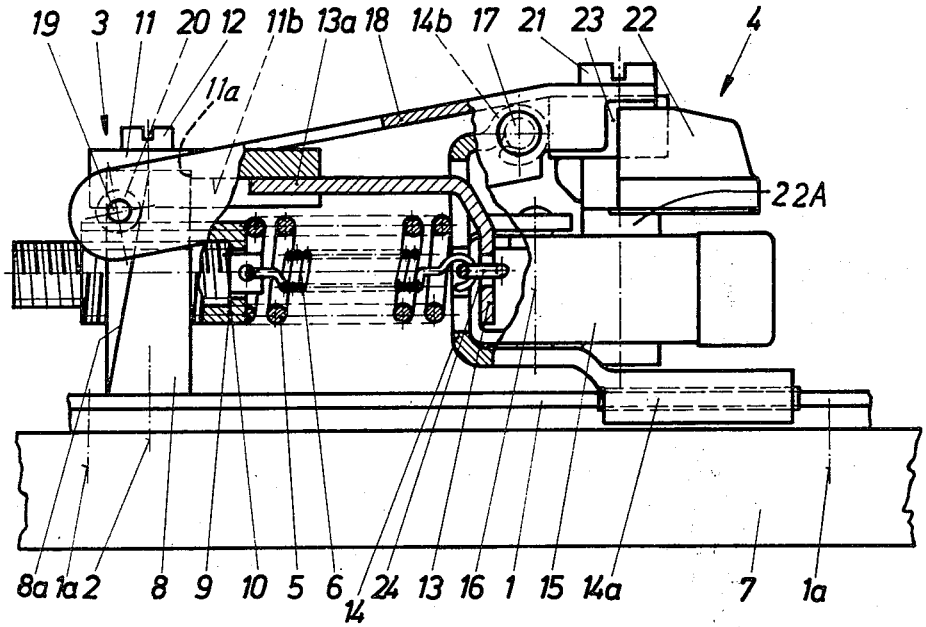
FIG. 1 is a partially sectioned side view of a front jaw.
Figure 2:
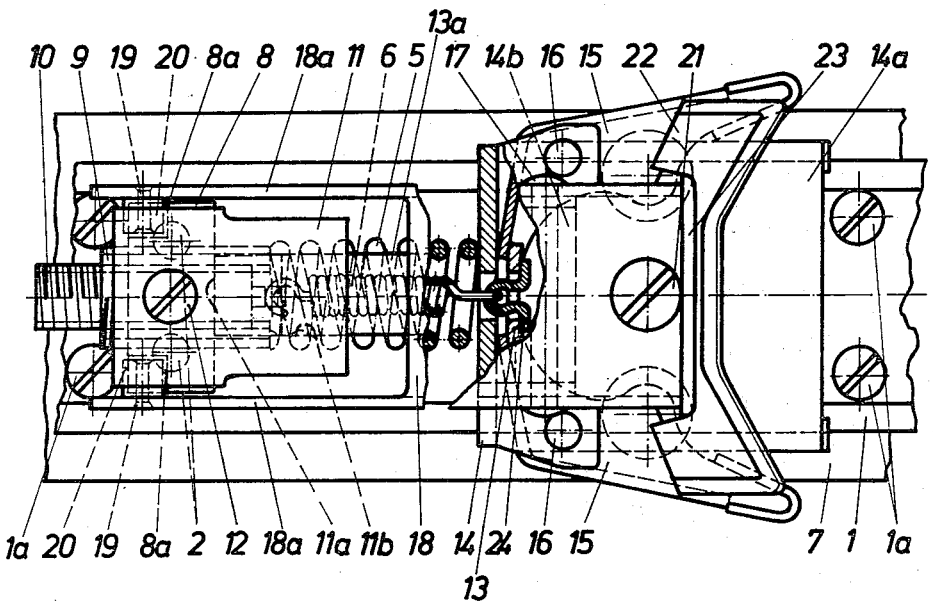
FIG. 2 is a top view of FIG. 1.

Referring to FIGS. 1 and 2, the general structure of a front jaw according to the invention will be discussed first.

A front jaw which is illustrated in FIGS. 1 and 2 consists substantially of track or rail 1 is secured to the ski 7 in a conventional manner by means of screws 1*a*. A ski-fixed part is secured on a rail 1 by means of screws 2. This ski-fixed part is constructed as a spring abutment 3 for a compression spring 5 which will yet be described. A support member 4 spaced from the spring abutment 3 is guided on the rail 1 in longitudinal direction of the ski 7 toward and away from the spring abutment.

The rail-fixed abutment 3 consists substantially of a base 8 having upwardly inclined sliding surfaces 8*a* which extend normally with respect to the longitudinal axis of the ski and at an acute angle to the vertical, enlarging upwardly and toward the tail end of the ski 7. An externally threaded bolt 10 and a guide piece 11 are also provided on the abutment.

A hollow internally and externally threaded pipe 9 is threadedly secured to and in approximately the center of the base 8 with the axis thereof extending parallel with respect to the longitudinal axis of the ski. The pipe 9 serves as a support for one end of the compression spring 5. The threaded bolt 10 has an anchorage member on its end which points toward the movable support member 4. The bolt 10 is threadedly secured to the internal threads on said pipe 9. A tension spring 6 is secured at one end thereof to the anchorage member.

The guide piece 11 is fixedly connected to the base 8 by means of a screw 12. A laterally extending recess or groove 11*a* is provided on the guide piece 11 and receives the upper end of the base 8 therein. The recess 11*a* is conformed to the shape of the base 8. The guide piece is secured to the base 8 to prevent a relative rotation therebetween. An indicator 13*a* is guided in a further and elongate recess 11*b*, or a groove on the underside of the guide piece 11. The elongate groove extends parallel with respect to the longitudinal axis of the ski. The function of the indicator 13*a* will be discussed hereinafter yet in greater detail.

The support member 4 consists of a frame 14 having a guide plate 14*a* slidably mounted on the guide rail 1. The frame 14 is movable to a limited extent on the rail 1 against the force of the pressure spring 5 which extends between the support member 4 and the abutment 3. The frame 14 carries in the center area conventional two arm levers 15, which are pivotally supported on the frame 14 by means of bolts 16 and can be swung out about the axes of these bolts. The upper region of the frame 14 is designed as a bearing sleeve 14*b*. A bearing axle 17 is received in the bearing sleeve 14*b*. A support part 18 is pivotally mounted on the axle 17. The support part 18 has two laterally spaced arms 18*a* with each thereof having a bolt 19 thereon, the axes of which each extend toward the base 8. A roller 20 is rotatably mounted on each of the bolts. The rollers 20 rest on the sliding surfaces 8*a* of the base 8.

An actually known down-holding means 22 for a not illustrated ski-shoe sole is connected by means of a screw 21 to the support part 18 and has an elastic element 23 positioned therebetween.

As a connection between the ski-fixed abutment 3 and the movable support member 4, aforementioned springs, namely, the pressure spring 5 and the tension spring 6 are provided. The other end of the tension spring 6 remote from the bolt 10 is thereby anchored in the support member 4 in a slide member 13 by means of a holding part 24, which in the top view is shaped similarly to the green letter omega. This anchoring can also take place on a suitably constructed region of the slide member 13 itself. The other end of the pressure spring 5 is supported on the central region on the frame 14.

Figure 3:
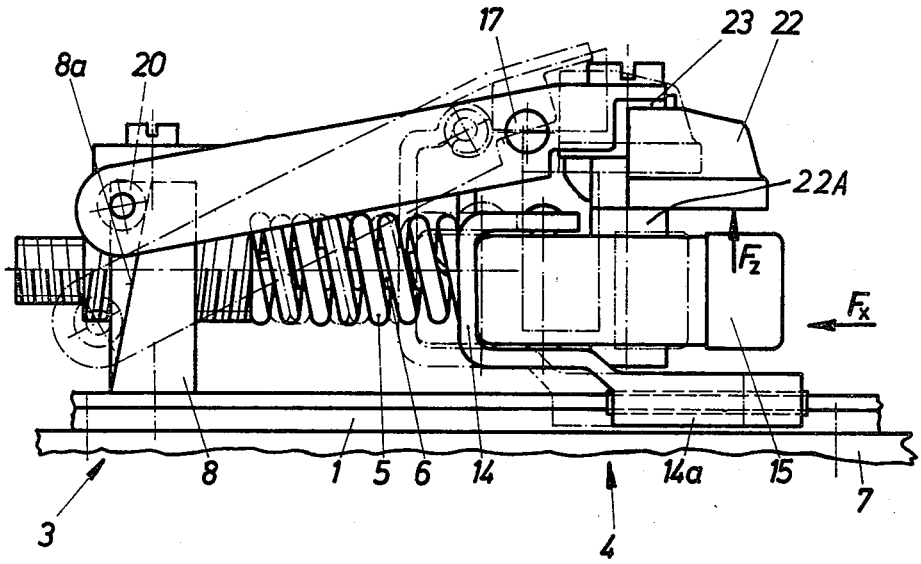
FIG. 3 is a side view of the same front jaw with a swivelled position thereof being illustrated in dash-dotted lines.
Figure 4:
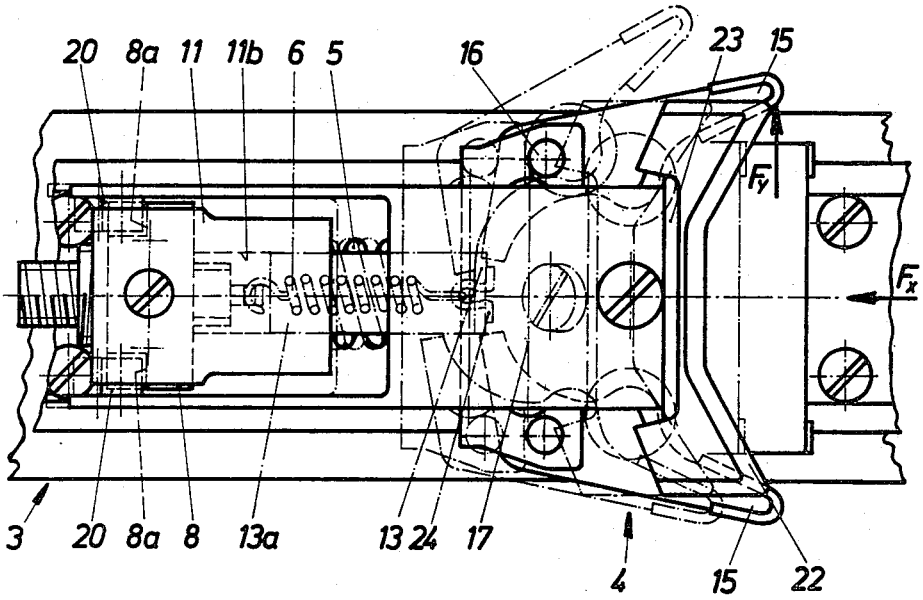
FIG. 4 is a top view of FIG. 3, wherein the dash-dotted illustration corresponds with the partially swivelled position of the bent lever and the sole down-holding means.

The sequence of movement during a release operation can be seen in FIGS. 3 and 4. If the two arm levers 15 are exposed to a horizontal load, which is illustrated in FIG. 4 by the arrow Fy, the two arm levers 15 pivot about the axes of the individual bolts 16 into their position which is illustrated in dash-dotted lines in this figure. The tension spring 6 is initially tensioned in this position through its anchorage on the slide member 13, which slides in the groove 11*b* on the guide piece 11. The guiding of the slide member 13 permits a swinging out of the individual two arm levers 15 independently from one another.

If at the same time a fall rearwardly occurs, a not illustrated ski shoe acts with a force, which is illustrated by an arrow Fz, on the down-holding means 22. The down-holding means 22 is pivoted upwardly about the axis of the bearing axle 17 through the so created force action and friction. The elastic element 23 is thereby slightly deformed between the support part 18 and the down-holding means 22, whereby the vertical position of the down-holding means 22 is maintained.

Figure 3A:
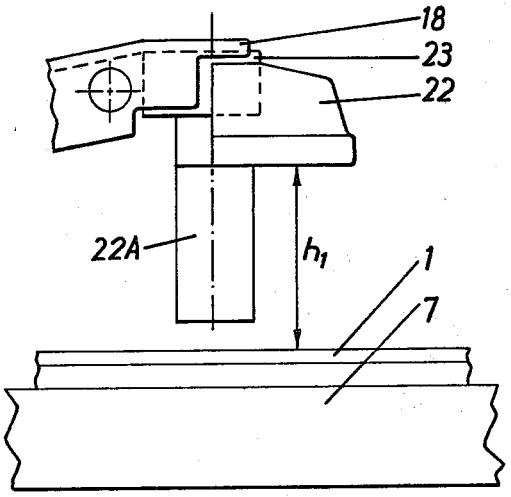
FIG. 3*a* to 3*c* are different positions of the down-holding structure during the release function.
Figure 3B:
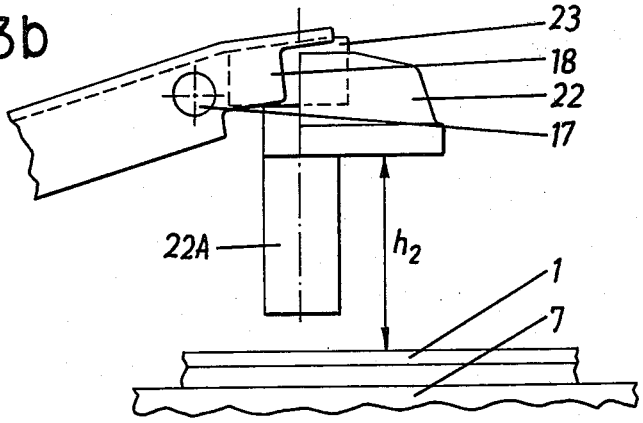
Figure 3C:
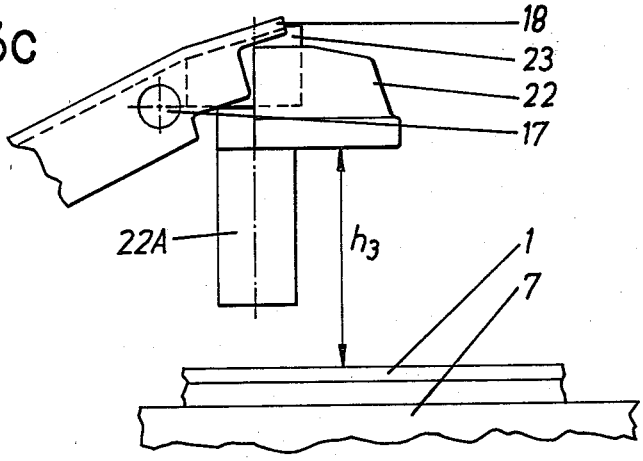

That is, the downwardly facing surface to which the arrow Fz points remains horizontally aligned. It will be readily understood that the support member 4 has a hollow sleeve-like portion thereon (not illustrated) into which is received a stem member 22A (FIGS. 3*a* to 3*c*). The stem member 22A is secured to the down-holding means 22 and support part 18 by the screw 21. The elastic element 23 is clamped between the support part 18 and the down-holding means 22. Thus, the support member 4 is moved forwardly (to the left in FIG. 3), the down-holding means 22 is moved vertically through the positions $h_1$, $h_2$ and $h_3$ and the stem member 22A remains vertically aligned.

The rollers 20 slide at the same time on the sliding surfaces 8*a* of the base 8 toward the rail 1. Due to the angle of the sliding surfaces and due to the rolling along of the rollers 20 thereon, a movement of the support member 4 by means of the guide plate 14*a* of the frame 14 on the rail 1 in direction toward the base 8 is created.

Based on the simultaneous movement of the support part 18 upwardly and toward the base 8, friction force is compensated for a constant release force is achieved (the tension spring 6 relaxes, however, the pressure spring 5 loads).

During skiing through a depression, the deforming of the not illustrated ski shoe is also absorbed by the pressure spring 5. The same is true in the case of a front fall, where the force acts in direction of the arrow Fx. (The sequence of movement is thereby as described earlier).

Figure 5:
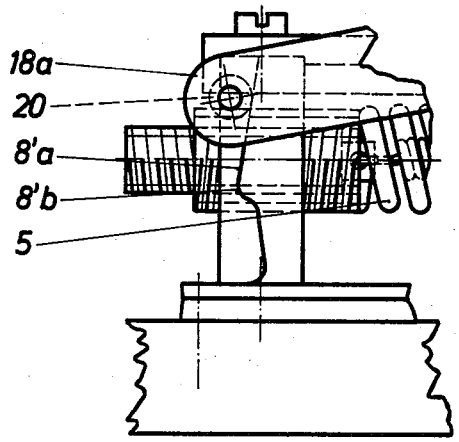
FIG. 5 is a side view of a detail for a rear jaw.

One embodiment of a sliding surface 8'*a* for a rear jaw can be taken from FIG. 5. Upon the occurrence of a vertical force, the here not illustrated down-holding means is swung upwardly in a conventional manner. The rollers 20 slide thereby also along the sliding surfaces 8'*a* to a roll-off edge 8'*b*. This forced control acts against the force of the pressure spring 5. After the rollers 20 rolled off the roll-off edge 8'*b*, the compression spring 5 is relieved and the not illustrated down-holding means can swing out upwardly unhindered and in a conventional manner and release the not illustrated ski shoe.

During stepping in—by stepping down on the rear jaw by means of a not illustrated stepping spur—the rollers 20 are urged upwardly over the roll-off edge 8'*b* against the force of the compression spring 5, whereby they reach the initial position (downhill skiing position) shown in FIG. 5 on the sliding surfaces 8'*a*.

The invention is not limited to the illustrated exemplarly embodiments. Further modifications exist, without having to depart from the scope of invention. The exemplary embodiments are, as was indicated in the beginning, limited to a front jaw. By using the given teaching, it is also possible, using suitable measures, to develop the jaw also as a rear jaw (see FIG. 5).

The embodiments of the invention in which an exclusive property or privilege is claimed are defined as follows:

1. A front or rear jaw of a release ski binding, comprising:

elongated track means adapted to be fixedly secured to a ski;

upstanding abutment means at one end of said track means;

support means mounted on said track means for movement along the length thereof;

sole holder means mounted on said support means for movement between a ski boot holding position and a ski boot release position;

first resilient means for resiliently resisting a movement of said sole holder means from said ski boot holding position toward said ski boot release position;

second resilient means engaging and extending between said support means and said abutment means for resisting movement of said support means toward said abutment means; and said first and second resilient means having oppositely directed active force directions whereby upon a movement of said support means toward said abutment means against said active force direction of said second resilient means the magnitude of force in the opposite active force direction of said first resilient means is reduced to thereby facilitate a movement of said sole holder means toward said ski boot release position with less resistance to said movement being provided by said first resilient means.

2. The front or rear jaw according to claim 1, wherein said support means also has thereon a sole down-holding means movable in a plane which extends vertically with respect to the upper surface of said ski, said sole down-holding means being movable solely against said active force direction provided by said second resilient means and only during a movement of said support means toward said abutment means.

3. The front or rear jaw according to claim 1 or claim 2, wherein said first resilient means is a tension spring, one end of which is connected to said base means, the other end of which is operatively connected to said sole holder means; and wherein said resilient means is a compression spring encircling said tension spring.

4. The front or rear jaw according to claim 3, wherein the operative connection between said other end of said tension spring and said sole holder means includes a slide member to which said other end is connected, said slide member being movable on said support means in response to a movement of said sole holder means toward ski boot release position.

5. The front or rear jaw according to claim 4, wherein said slide member has a indicator element thereon, said slide member together with said support member being adjustable relative to said abutment means.

6. The front or rear jaw according to claim 5, wherein said sole holder means includes a pair of individual two-arm levers pivotally mounted on said support means, and wherein said slide member slides in a groove in a guide piece on said support means in order to assure a swinging out of the individual sole holding levers independently of one another.

7. The front or rear jaw according to claim 1, wherein said support means includes a guide plate movable on said track means and a bearing sleeve on an upwardly projecting region thereof, a bearing axle on said upwardly projecting region for a sole down-holding means, and wherein said sole down-holding means is held on said support means by an elastic element positioned therebetween.

8. The front or rear jaw according to claim 2 or claim 7, wherein said abutment means has at least one slide surface thereon steeply inclined to the upper surface of said ski, said sole down-holding means including a member adapted to engage the top surface of a sole of a ski boot and an arm means pivotally secured to said member, said arm means extending toward said abutment means and having roller means thereon engaging said slide surface.

9. The front or rear jaw according to claim 8, wherein said slide surface has a roll-off edge dividing said slide surface into two horizontally offset, vertically upright surfaces to thereby enable, following a movement of said roller means from one surface to the other, a vertical movement of said member free of influence from said second resilient means.

10. The front or rear jaw according to claim 8, wherein there are provided two sliding surfaces on said abutment means each extending in a plane which lies substantially inclined to the upper surface of the ski on each surface of which rests a roller means when said jaw is in the downhill skiing position, said roller means being supported on laterally spaced arms of said arm means, wherein said two roller means are arranged resting on the sliding surfaces and movably along the same, and wherein the two sliding surfaces each have one roll-off edge dividing each sliding surface into two horizontally offset surfaces, whereby when said roller means moves from one surface to the other over said roll-off edge, said second resilient means is at least partially relieved and said down-holding means is released.

* * * * *